United States Patent [19]

Semaan et al.

[11] Patent Number: 4,905,444

[45] Date of Patent: Mar. 6, 1990

[54] METHOD AND SYSTEM FOR MOUNTING BUILDING WALL PANELS TO BUILDING FRAMES, INCORPORATING MOUNTING MEANS ELEMENTS WITH TWO DEGREES OF MOTION FREEDOM

[75] Inventors: Robert I. Semaan; Ezzat S. Semaan, both of Omaha, Nebr.

[73] Assignee: Connection Specialties Inc., Omaha, Nebr.

[21] Appl. No.: 364,849

[22] Filed: Jun. 12, 1989

[51] Int. Cl.[4] ..... F04B 1/41

[52] U.S. Cl. ..... 52/710; 52/235

[58] Field of Search ..... 52/167, 235, 710

[56] References Cited

U.S. PATENT DOCUMENTS

| | | | |
|---|---|---|---|
| 1,594,412 | 8/1926 | Garvin . | |
| 1,841,887 | 1/1932 | Goldsmith et al. . | |
| 3,005,292 | 10/1961 | Reiland | 52/710 |
| 3,994,107 | 11/1976 | Aughuet | 52/235 |
| 4,073,107 | 2/1978 | Rousseau | 52/235 |
| 4,194,333 | 3/1980 | Paton et al. . | |
| 4,782,635 | 11/1988 | Hegle | 52/235 |

FOREIGN PATENT DOCUMENTS

| | | | |
|---|---|---|---|
| 2283271 | 3/1976 | France | 52/710 |

*Primary Examiner*—John E. Murtagh

*Attorney, Agent, or Firm*—James D. Welch

[57] ABSTRACT

A system for mounting building wall panels to building frames, and a method of its use, are disclosed. The system is comprised of a multiplicity of insertional frames, at least some of which provide a mounting means element therein with two degrees of motion freedom, which insertional frames are secured to building wall panels. The system provides for quick, easy and economical mounting of building wall panels to building frames by construction personnel as the mounting means elements in the insertional frames can be adjusted to match the location of the corresponding mounting means on a building frame. The invention also, most importantly, provides protection against the development of potentially damaging stresses in building wall panels mounted to a building frame as a result of seismic activity, thermal expansion, wind induced building shape changes etc.

2 Claims, 2 Drawing Sheets

METHOD AND SYSTEM FOR MOUNTING BUILDING WALL PANELS TO BUILDING FRAMES, INCORPORATING MOUNTING MEANS ELEMENTS WITH TWO DEGREES OF MOTION FREEDOM

TECHNICAL FIELD

This invention relates to building wall panels, typically but not exclusively of precast concrete construction, and more particularly to an easy to use means for mounting building wall panels to building frames, which means incorporates two degrees of motion freedom between mounting means elements in a building wall panel and mounting means elements on a building frame, the purposes of which are to allow alignment and more importantly to prevent build-up of potentially damaging stresses in building wall panels which are mounted to buildings.

BACKGROUND

Modern building construction techniques have increasingly focused upon the use of a basic strength providing building frame, on the outside of which are mounted covering building wall panels. The reason that this approach to modern building construction has grown in use is based in economics. That being the case, a system and method of its use which provides construction personnel a quicker, easier and less costly way to mount building wall panels to building frames would be desirable. In particular, a problem faced by construction personnel when mounting building wall panels to building frames is a difficulty in aligning mounting means elements secured to a building wall panel with mounting means elements on a building frame. Often times when a multiplicity of such mounting means elements are present they simply do not all align. Construction personnel must then spend time to relocate and/or adjust the location of the mounting means elements on the building frame etc. An invention which would facilitate the ability of construction personnel to easily adjust the location of the mounting means elements secured to building wall panels so that they align with the mounting means elements attached to building frames would then provide economic and construction convenience benefits. An invention which, to some extent, demonstrates such a capability is taught in a patent to Paton, U.S. Pat. No. 4,194,333. In Paton there is taught a system of inserts which are cast into building wall panels. Tongue elements mount into certain of the inserts by way of slots in the tongue elements, in a way that allows the tongue elements to move along the length of the inserts. Attached to the tongue element distal to the insert body is a clamp. The clamp serves to attach to a building frame. The inserts are taught as being cast into building wall panels so that the tongue motion is allowed vertically, as a building wall panel is viewed in elevation when it is mounted to a building frame. It will be appreciated that construction personnel can then easily adjust the vertical alignment of the mounting means elements in the building wall panel to match with the vertical location of the complementary mounting means elements on the building frame during the construction process. The Paton Patent, however, teaches against provision of a second degree of motion freedom, (e.g. horizontal), between the mounting means elements in the building wall panel and those on a building frame. The reason given is that the building wall panels used with the system are structurally reinforced and are meant to provide a restraining force against roof diaphragm horizontal shearing forces during seismic or other (e.g. wind), activity. Were the panels mounted in a way that allowed relative horizontal motion between the mounting means elements in the building wall panels, and the mounting means elements on the building frame, said benefit would be lost. While the teachings of Paton are of interest, they fail to recognize that many present day building wall panels are not constructed to provide strength enhancing structural capacity, but rather they serve aesthetic purposes. Some such building wall panels may incorporate brittle materials such as window glass, or thin granite and marble. If a roof diaphragm shear force is applied to such a panel, the result is, simply, that the building wall panel will develop unacceptable visually perceptible, strength reducing cracks. In many applications, not only would the presence of a capacity for horizontal motion between the mounting means elements in building wall panels and those on a building frame not be a detriment, it would be of great benefit. Said benefit would avail and accrue to construction personnel by allowing easy, quick economical alignment between complementary mounting means elements in building wall panels and on building frames, and to building owners who, most importantly, will not experience loss due to building wall panel failure resulting from unreleased stresses in said building wall panels. Such stresses can be generated, not only by seismic activity, but also by building shape changes caused by wind or as a result of temperature related building wall panel expansion. It is noted that the Paton invention allows for release of stresses caused by vertical forces applied to building wall panels, but no such provision is provided for similar stress release in a horizontal direction. It is also of interest to note that many modern Municipal Building Seismic Codes require that architectural building wall panels be capable of allowing for relative horizontal movement between building stories. This capability can not be provided by the use of Paton system, hence, there arises the need for a building wall panel mounting means with two degrees of motion freedom.

The inventor is unaware of any reference which teaches the combination of building wall panels with mounting means elements secured thereto, which provides for two degrees of motion freedom for the mounting means elements. The inventor is aware of patents to Garvin, U.S. Pat. No. 1,594,412 and to Goldsmith et al., U.S. Pat. No. 1,841,887, which teach devices that provide a nut mounted therein with two degrees of motion freedom. Said Patents teach rectangular frames within which are mounted brackets which can slide along the length of the frames. Within the brackets are found nuts which can slide along the length of the bracket, said motion being perpendicular to the direction of motion allowed to the brackets within the frames. The resulting devices are taught as being useful in providing a means for supporting pipes etc. on brick or concrete walls into which they are embedded. Said Patents, however, do not mention or allude to use of such a device in mounting building wall panels to building frames. Also, the design of the devices is such that traction and compression forces applied thereto could cause the frame to break.

Based on the foregoing, it can be concluded that a well designed building wall panel mounting system, and its method of use, which building wall panel mounting system provides for mounting means elements in a building wall panel, which mounting means elements are allowed two degrees of motion freedom, would be beneficial. A need exists for such a building wall panel mounting system and method of its use.

DISCLOSURE OF THE INVENTION

The present invention is comprised of specially designed insertional frames in combination with building wall panels and means by which said combination is attached to a building frame. The insertional frames are comprised of four parts: a mounting means element, demonstratably referred to as a nut hereinafter, a mounting means element, (nut), holding bracket which houses the nut in a fashion allowing the nut freedom of motion along the length thereof, an inner nut holding bracket retainer and an outer building wall panel engaging element. The nut holding bracket fits in a space formed between the outer building wall panel engaging element and the inner nut holding bracket retainer in a fashion allowing the nut holding bracket freedom to move along the length of the outer building wall panel engagement element and limited by the inner nut holding bracket retainer at the ends thereof, which motion is in a direction perpendicular to that allowed the nut within the nut holding bracket. The nut is accessible through a cut out in the top portion in the outer building wall panel engagement element. The outer building wall panel engaging element is also constructed with tapering sides, which the nut holding bracket is formed to snuggly, but slideably fit within. The insertional frame construction will be more clearly described in the Detailed Description Section.

The present invention results, as alluded to, from combining building wall panels with insertional frames and means by which the combination is attached to building frames. The purposes of the invention, as alluded to in the Background Section, are to provide building wall panels with mounting means elements that make possible quick, easy economical mounting of the building wall panels to building frames and which, most importantly, protect the building wall panels against potentially damaging stress causing forces. The purposes can be fulfilled by mounting insertional frames as described into each building wall panel. The purposes, however, can be fulfilled with less than all insertional frames mounted in a building wall panel providing two degrees of motion freedom to the mounting means elements in the insertional frames. For instance, an insertional frame at one corner of a building wall panel, at the bottom thereof, can be fixed, that is have mounting means elements therein with no degrees of motion freedom. Other insertional frames mounted at other locations in the building wall panel, however, are required to provide mounting means elements with one or two degrees of motion freedom. A single degree of motion freedom in the horizontal direction for mounting means elements is desirable in insertional frames located horizontally from a fixed mounting means element insertional frame located at the bottom of a building wall panel, to allow relief of temperature induced building wall panel expansion stresses. Two degrees of motion freedom, in vertical and horizontal directions, are essential in insertional frames located in a building wall panel vertically above a fixed mounting means element insertional frame. Depending on the location of additional insertional frames, varying degrees of motion freedom in insertional frames are required. This point will be elaborated upon in the Detailed Description Section herein.

The means by which the building wall panel and insertional frames combination mount to a building frame, in a preferred embodiment, comprises a threaded eye-bar or rod member which screws into the mounting means element, (e.g. nut), in the insertional frame, which threads are at one end of said threaded eye-bar or rod. At the end of the threaded eye-bar distal to the screw threads is located an eye through which a bolt can extend and screw into a mounting means element, (e.g. a nut), which has been affixed to a metal plate, which metal plate is in turn secured to a building frame by welding or by embedding anchors protruding therefrom into masonary material such as concrete, etc., or by other means. It is also possible to directly weld a rod to a metal building frame.

SUMMARY OF THE INVENTION

Modern building construction techniques have increasingly focused upon the use of a basic strength providing building frame, on the outside of which are mounted covering building wall panels. Mounting means presently available present problems to construction personnel who must align mounting means elements on building wall panels and those on building frames. A Patent to Paton teaches a building wall panel in which are insertions that provide mounting means elements with one degree of motion freedom, that being in the vertical direction. Such mounting means provides for improved alignment capability between mounting means elements in building wall panels and those on building frames. The lack of a second degree of motion freedom, (e.g. horizontal), however, leaves construction personnel with remaining problems. As well, building wall panel mounting means which do not provide two degrees of motion freedom between mounting means elements therein and the mounting means elements on a building frame allow potentially damaging stresses to develop in the building wall panels. This can occur as a result of seismic activity, thermal expansion or building shape changes induced by wind forces, etc.

The present invention combines building wall panels with insertional frames mounted therein, and with means for attaching said combination to build frames. At least some of the insertional frames provide mounting means elements, (e.g. nuts), which are free to move in two directions. That is said mounting means elements in the building wall panels provide two degrees of motion freedom.

A purpose of the present invention is to provide construction personnel with a system and method of its use which makes the mounting of building wall panels to building frames quicker, easier and more economical by allowing alignment between mounting means elements in insertional frames in the building wall panels, and corresponding mounting means elements on building frames.

Another, and most important, purpose of the present invention is to provide a system which prevents potentially damaging stresses from developing in building wall panels mounted to building frames, which stresses can result from forces created by seismic activity, thermal building wall panel expansion or wind induced building shape changes etc.

DETAILED DESCRIPTION

Figure 1:
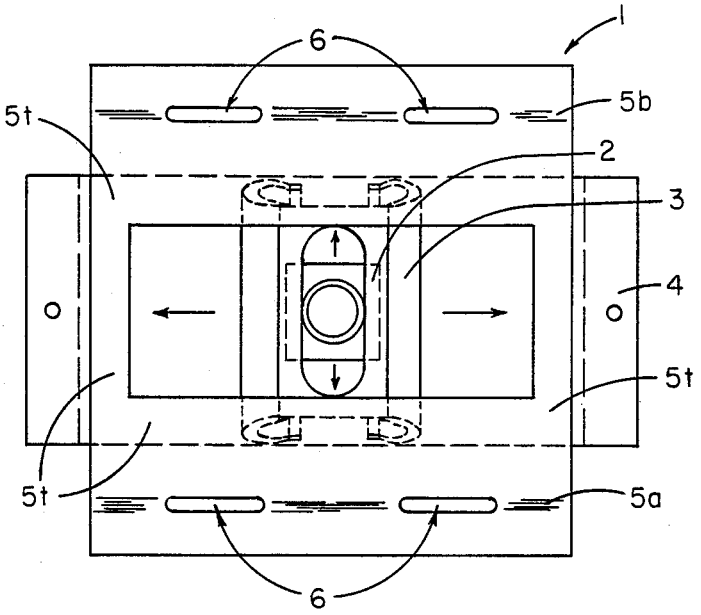
FIG. 1 is a top view of an insertional frame.
Figure 2:
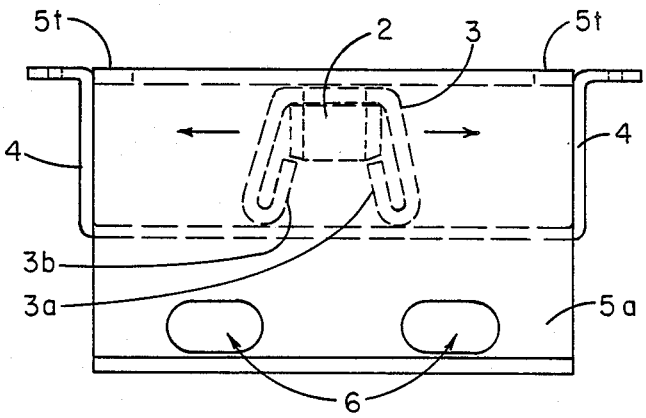
FIG. 2 is a side elevational view of an insertional frame.

Turning now to the Figures, the preferred embodiment of the present invention can be better understood. In FIG. 1 the entire insertional frame is identified as (1). The insertional frame has as its basic part the outer building wall panel engaging element, which though typically of one piece construction, is identified by (5*b*), (5*a*) and (5*t*) to designate the sides and top respectively. The insertional frame (1) has as another part the inner mounting means element, (e.g. nut), holding bracket retainer (4). [Note, a nut is the preferred mounting means element in the insertional frame. Although other mounting means elements are not beyond the scope of the present teachings, the mounting means element will be demonstratably referred to as a nut herein]. This element of the invention mounts inside the outer building wall panel engaging element so that its top extent is coplanar with the top of the outer building wall panel engaging element and so its lower extent falls at approximately one half the height of the outer building wall panel engaging element as viewed in elevation from the end. This arrangement is shown very well in the end and side elevational views of FIGS. 3 and 2 respectively. Next, the insertional frame includes the nut holding bracket (3) in which a nut (2) is snuggly, but slideably, held so that it has freedom to move within the nut holding bracket (3) between the extreme ends of same, which extreme ends come into contact with the inner sides of the outer building wall panel engaging element. The sides of the outer building wall panel engaging element are shown as (5*b*) and (5*a*). Note also, that the nut holding bracket (3) is free to move in a direction perpendicular to that allowed to the nut, along the extent of the outer building wall panel engaging element, between limits set by the inner nut holding bracket retainer (4) at the ends thereof and within the space between the outer building wall panel engaging element and the inner nut holding bracket retainer. This is best appreciated by reference to FIG. 2, while the allowed motion of the nut (2) is best appreciated by reference to FIGS. 1 and 3.

Figure 3:
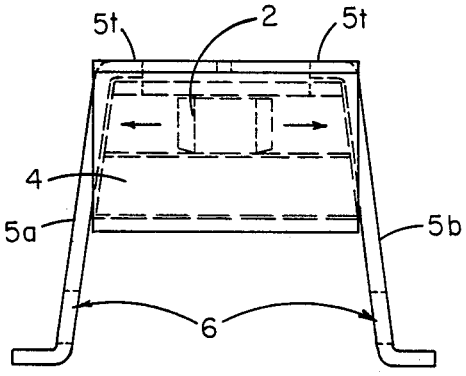
FIG. 3 is an end elevational view of an insertional frame.
Figure 4:
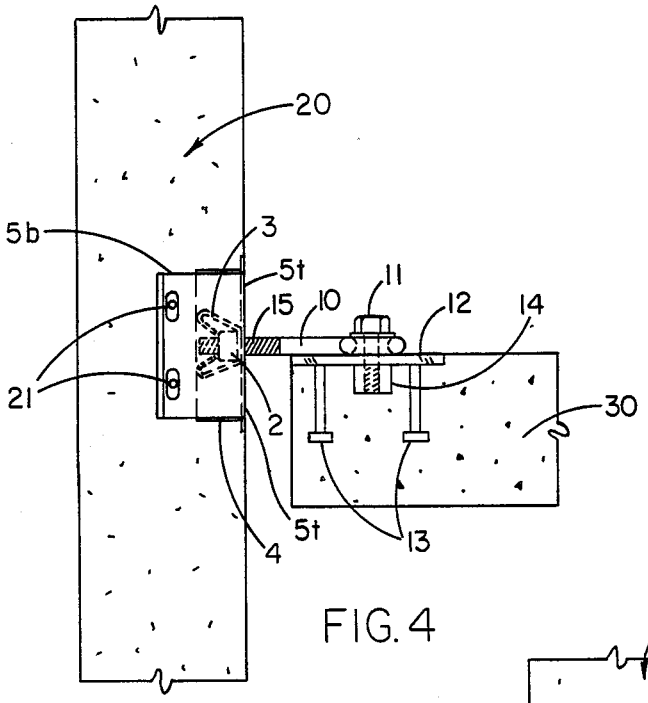
FIG. 4 is a side elevational view of a system for mounting building wall panels to a building frame.
Figure 5:
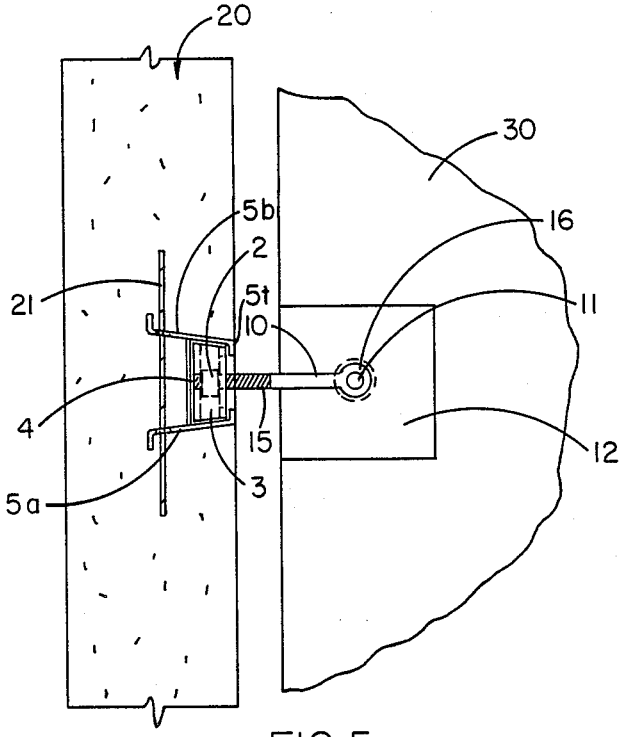
FIG. 5 is a top view of a system for mounting building wall panels to a building frame.

Note, in particular that the sides (5*b*) and (5*a*) of the outer building wall panel engaging element are tapered. This is best seen in FIG. 3. Note that the nut holding bracket (3) also tapers in a likewise manner so as to snuggly, but slideably, fit against the inner sides of the outer building wall panel engaging element. This is best appreciated by reference to FIGS. 1 and 3 which show a top and end elevational view of the insertional frame respectively. The purpose of the described design is to provide interaction between the nut holding bracket (3) and the outer building wall panel engaging element sides (5*b*) and (5*a*) when, as is shown in FIGS. 4 and 5, a threaded (15) eye-bar or rod (10) is screwed into the nut (2) and a traction force applied which tends to pull the nut (2) and the nut holding bracket (3) away from building wall panel engaging element. The interaction caused by a traction force will occur between the outer sides of the nut holding bracket and the inner sides of the outer building wall panel engaging element, where contact is made there-between. A restraining force will develop thereat which force is distributed to the casting material in the building wall panel. Note also that the nut holding bracket (3) is designed so that a compression force applied to the nut (2) will cause a tighter contact between the nut holding bracket legs (3*a*) and (3*b*) which support nut (2) from beneath. A Compression force applied to the nut (2) is transmitted to the top surface of the inner nut holding bracket retainer, and to some extent to the sides of the outer building wall panel engaging element (5*b*) and (5*a*) because of the tapered shape of said sides. Traction and compression forces applied by attachment means as alluded to, thus, are transmitted to force distributing elements of the insertional frame (1) and on to the building wall panel in which they are mounted, in such a fashion that they do not cause damage to the insertional frame (1) or the building wall panel.

Also to be noted are the holes (6) in the sides (5*b*) and (5*a*) of the building wall panel engagement element. Said holes (6) serve to aid attachment to a building wall panel (20) as implied in FIG. 4. It is customary to cast building wall panels with insertional frames in place, and let casting material set up around said insertional frames. The casting material can be, but is not limited to concrete. The casting material, it will be appreciated, will be continuous through holes (6). It is also customary to place reinforcement bars (21) through holes (6) so that casting material can interact with same over greater area, thereby better retaining the insertional frame (1) within the building wall panel (20). Note that while the foregoing describes one approach to securing insertional frames into building wall panels, the scope of the present invention includes any means by which the insertional frame can be well secured to a building wall panel.

Next, the preferred means for attaching the threaded eye-bar (15) or rod (10) to a building frame is by way of a bolt (11) and nut (14) as shown in FIG. 4. Note that the nut (14) is secured to a plate (12), perhaps by a weld. FIG. 4 shows the plate (12) with anchors (13) extending therefrom, which anchors (13) are cast into concrete or equivalent material. FIG. 5 shows plate (12) in top view. Note that (30) can represent concrete or metal building frames. If the latter is the case, the plate (12) can be eliminated and rod (10) attached directly to (30), perhaps by a welding technique.

Figure 6:
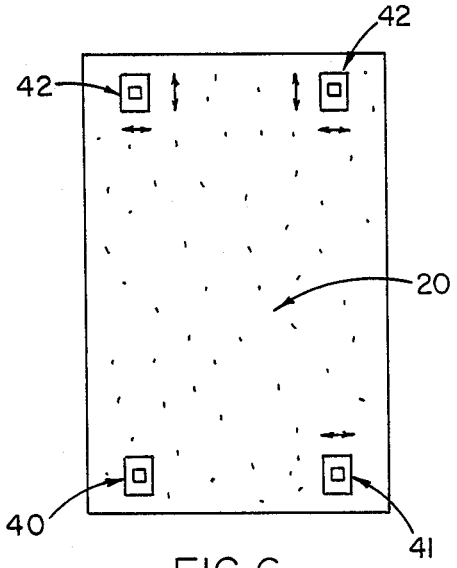
FIG. 6 shows a building wall panel in elevation with an insertional frame in each corner thereof.

In practise two or more insertional frames which provide insertional frame mounting means elements, shown as a nut (2) in the Figures, are secured to a building wall panel. Commonly one insertional frame is placed at each corner of a building wall panel, (see FIG. 6), although insertional frames can be placed at other locations instead of, or in addition to insertional frames at said corners. If an insertional frame is placed at each corner of a building wall panel, then four are required, of which, it will be appreciated, only two must provide two degrees of motion freedom to the mounting means element therein to meet the purposes of the present invention. Referring to FIG. 6, two lower insertional frames (40) and (41) are shown. Insertional frame (40) can provide a fixed mounting means element and insertional frame (41) a mounting means element with only a horizontal degree of freedom. Such is beneficial in preventing buildup of horizontal temperature induced building wall panel expansion stresses. If the upper insertional frames (42), which are vertically above lower fixed mounting means element containing insertional frame (40), are constructed to provide mounting means elements with two degrees of freedom, the purposes of the present invention will be met. Other functionally equivalent scenarios of insertional frame construction and placement in building wall panels can be developed and are within the scope of the present invention, hence, the foregoing scenario is to be read as exemplary and not exclusive.

In practise, construction personnel can secure mounting means elements to building frames, and then very quickly, easily and economically adjust the position of corresponding mounting means elements in building wall panels to line up, thereby allowing the building wall panel to be mounted to the building frame without time consuming, cost increasing modification of the mounting means element location on the building frame. Also, and of primary importance, once building wall panels are secured in place with insertional frames as taught herein, the present invention will act as a buffer to potentially damaging stresses which otherwise can build up in building wall panels as a result of seismic activity, thermal expansion, wind induced building shape changes etc.

It must also be mentioned that building wall panels mounted to buildings by use of insertional frames as described herein, are normally also supported at their bottom extent by other weight bearing means. The insertional frames provide restraint only forces. The teachings herein are to be understood in that light.

Finally, while the teachings herein focus on placing the mounting means element with two degrees of freedom on insertional frames secured to building wall panels, it is also possible to place such mounting means elements with two degrees of freedom on building frames. Such is within the scope of the present invention and the Claims herein are to, by implication, include such an interpretation.

Having hereby disclosed the subject matter of this invention, it should be obvious that many modifications, substitutions and variations of the present invention are possible in light of the teachings. It is therefore to be understood that the invention may be practised other than as specifically described, and should be limited in breadth and scope only by the claims.

I claim:

1. An insertional frame for use in a building wall panel mounting system, which insertional frame comprises:

a. a mounting means element, b. a mounting means element holding bracket, c. an inner mounting means element holding bracket retainer, and d. an outer building wall panel engaging element, which mounting means element is held within the mounting means element holding bracket between a top aspect and bottom legs thereof, in a fashion allowing the mounting means element to slide along the length of the mounting means element holding bracket, and which mounting means element holding bracket is positioned within a space formed between the inner mounting means element holding bracket retainer upper surface and the inner top and side surfaces of the outer building wall panel engaging element when the former is placed inside the latter and oriented so that the outer sides of the former contact the inner sides of the latter and the top aspects of both the former and latter are coplanar when the insertional frame is viewed in elevation from the side or end thereof, in a fashion allowing the mounting means element holding bracket to move within the identified space along the length of the inner mounting means element holding bracket retainer, which motion is perpendicular to the motion allowable to the mounting means element in the mounting means element holding bracket, which outer building wall panel engaging element has tapered sides as viewed in elevation from the end of the insertional frame, and which mounting means element holding bracket has a shape which causes the outer sides thereof to snuggly, but slideably, fit between the inner sides of the outer building wall panel engaging element, while the lower leg extremities of the mounting means element holding bracket sit on the upper surface of the lower portion of mounting means element bracket retainer.

2. An insertional frame as in claim 1, in which the mounting means element in the insertional frame is a nut.

* * * * *